US005443744A

United States Patent [19]

Bloch et al.

[11] Patent Number: 5,443,744

[45] Date of Patent: Aug. 22, 1995

[54] NON SILICONE AGGRESIVE ALKYL PHOSPHATES AS LUBRICATION OIL ADDITIVES

[75] Inventors: Ricardo A. Bloch, Scotch Plains; Antonio Gutierrez, Mercerville; Jack Ryer, East Brunswick; Raymond F. Watts, Long Valley; Craig W. Gleason, Scotch Plains, all of N.J.

[73] Assignee: Exxon Chemical Patent Inc., Linden, N.J.

[21] Appl. No.: 168,840

[22] Filed: Dec. 17, 1993

[51] Int. Cl.[6] ..... C10M 137/14

[52] U.S. Cl. ..... 252/32.7 E; 252/32.7 R

[58] Field of Search ..... 252/32.7 E, 32.7 R; 558/70, 89

[56] References Cited

U.S. PATENT DOCUMENTS

| | | | |
|---|---|---|---|
| 3,004,056 | 10/1961 | Nunn, Jr. et al. | 558/114 |
| 3,285,954 | 11/1966 | Uhing et al. | 252/32.7 E |
| 3,309,428 | 3/1967 | Calhoun et al. | 252/32.7 E |
| 3,316,332 | 4/1967 | Calhoun et al. | 252/32.7 E |
| 4,154,779 | 5/1979 | Kreutzer | 558/113 |
| 4,511,480 | 4/1985 | Outlaw et al. | 252/8.555 |
| 4,776,969 | 10/1988 | Ryer et al. | 252/46.7 |
| 4,853,139 | 8/1989 | Ichihashi | 252/32.7 E |
| 4,952,328 | 8/1990 | Davis et al. | 252/32.7 E |
| 5,185,090 | 2/1993 | Ryer et al. | 252/46.6 |
| 5,202,036 | 4/1993 | Ripple et al. | 252/33.4 |
| 5,242,612 | 9/1993 | Ryer et al. | 252/46.7 |
| 5,306,436 | 4/1994 | Born et al. | 252/32.7 E |

FOREIGN PATENT DOCUMENTS

| | | |
|---|---|---|
| 0551760A2 | 7/1993 | European Pat. Off. . |
| WO88/03144 | 5/1988 | WIPO . |
| WO90/09386 | 8/1990 | WIPO . |

OTHER PUBLICATIONS

Lubricant Additives, Smallheer & Smith. 1967.

*Primary Examiner*—Prince Willis, Jr.
*Assistant Examiner*—James M. Silbermann
*Attorney, Agent, or Firm*—T. J. Shatynski

[57] ABSTRACT

This invention provides a novel antiwear and antioxidant additive for use in lubricating oils, particularly automatic transmission fluids. The novel additive is the reaction product of a phosphating agent and a thioalcohol. The reaction product is nonaggressive to silicone-based seals.

8 Claims, No Drawings

NON SILICONE AGGRESIVE ALKYL PHOSPHATES AS LUBRICATION OIL ADDITIVES

BACKGROUND OF THE INVENTION

1. Field of the Invention

This invention concerns a novel phosphorus-based reaction product and its use as an antioxidant and antiwear additive in lubrication oils, particularly automatic transmission fluids. The novel additive surprisingly does not attack silicone-based seals.

2. Description of Related Art

Phosphorus-based lubrication oil additives are known to attack silicone-based seals. In particular, laboratory studies indicate that dialkyl hydrogen acid phosphates of the type $$(C_8H_{17}O)_2-\overset{\overset{\displaystyle O}{\|}}{P}-OH$$

cause deterioration of silicone-based seals when used in lubrication oils such as automatic transmission fluids ("ATF"). However, dialkyl hydrogen acid phosphates of the type described above are effective-antiwear agents. Therefore, it would be desirable to have a similar antiwear agent which is not aggressive to silicone-based seals when used in lubrication oils, particularly ATF systems.

This invention remedies the silicone-seal deterioration problem by providing a sulfur-containing phosphate ester reaction product. This reaction product is not only an effective antiwear additive but also a surprisingly nonaggressive additive to silicone-based seals when used in lubrication oil systems. Additionally, the reaction product of this invention is an excellent antioxidant.

SUMMARY OF THE INVENTION

The lubrication oil additive of this invention comprises the reaction product of a phosphating agent and an alcohol selected from the group consisting of (I), (II), and mixtures thereof, where (I) and (II) are $$A-OH \qquad (I)$$

and $$OH-B-OH \qquad (II)$$

wherein

A is $$\begin{array}{l} Y \\ | \\ CH-(OCH_2CH_2)_n- \\ | \\ X \end{array} \quad \text{or} \quad \begin{array}{l} Y-CH-(OCH_2\underset{\displaystyle CH_3}{\underset{|}{CH}})_n; \\ \quad\;\; | \\ \quad\;\; X \end{array}$$

X is H or $RSCH_2-$;

Y is $$RSCH_2-,\quad \begin{array}{l} RSCH\underset{\displaystyle CH_3}{\underset{|}{CH_2}}- \end{array},\quad \begin{array}{l} RSCH\underset{\displaystyle CH_2\,|\,CH_3}{\underset{|}{CH_2}}- \end{array},\quad \begin{array}{l} RSCH\underset{\displaystyle CH_3}{\underset{|}{-}} \end{array},$$

-continued $$\begin{array}{l} RSCH_2\underset{\displaystyle CH_3}{\underset{|}{CH}}- \end{array} \quad \text{or} \quad \begin{array}{l} RSCH_2\underset{\displaystyle CH_2\,|\,CH_3}{\underset{|}{CH}}-; \end{array}$$

n is an integer from 0–12, preferably 0;

B is $-CH_2CH_2SCH_2CH_2-$, $-CH_2CH_2SSCH_2CH_2-$ or $$\begin{array}{l} R_1\underset{\displaystyle |}{CH}CH_2SR_2-; \end{array}$$

and R, $R_1$, and $R_2$ are the same or different and are H or a hydrocarbyl group containing up to 50 carbon atoms.

In another embodiment, this invention concerns a lubricating oil composition comprising a lubrication oil basestock and an amount of the disclosed additive at least effective to impart antiwear and antioxidant properties to the lubrication oil basestock while not being aggressive to silicone-based seals.

Accordingly, a further embodiment of this invention relates to a method of inhibiting wear, oxidation, and silicone seal deterioration in lubrication oil systems, including power transmission fluid systems, and particularly automatic transmission fluid systems.

DETAILED DESCRIPTION OF THE INVENTION

The phosphating agents contemplated for use in this invention are the oxides of phosphorus which when reacted with alcohols (I) and (II) form the desired phosphate ester reaction product. Suitable phosphorus oxides include phosphorus trioxide, phosphorus tetraoxide, and phosphorus pentoxide. Phosphorus pentoxide is the preferred phosphating agent.

The R, $R_1$, and $R_2$ groups of the alcohols (I) and (II) may be the same or different and are straight-chained, branched, or cyclic hydrocarbyl groups. Representative hydrocarbyl groups include alkyl, alkenyl, cycloalkyl, aralkyl, alkaryl, and hetero-containing analogs thereof.

The hetero-containing hydrocarbyl groups may contain one or more hetero atoms. A variety of hetero atoms can be used and are readily apparent to those skilled in the art. Suitable hetero atoms include, but are not limited to, nitrogen, oxygen, phosphorus, and sulfur.

When the hydrocarbyl group is alkyl, straight-chained alkyl groups are preferred—typically those that are about $C_2$ to $C_{18}$, preferably about $C_4$ to $C_{12}$, most preferably about $C_6$ to $C_{10}$ alkyl. When the hydrocarbyl group is alkenyl, straight-chained alkenyl groups are preferred—typically those that are about $C_3$to $C_{18}$, preferably about $C_4$ to $C_{12}$, most preferably about $C_6$ to $C_{10}$ alkenyl. When the hydrocarbyl group is cycloalkyl, the group typically has about 5 to 18 carbon atoms, preferably about 5 to 16, most preferably about 5 to 12. When the hydrocarbyl group is aralkyl and alkaryl, the aryl portion typically contains about $C_6$ to $C_{12}$, preferably 6 carbon atoms, and the alkyl portion typically contains about 0 to 18 carbon atoms, preferably 1 to 10.

Straight-chained hydrocarbyl groups are preferred over branched or cyclic groups. However, if the hydrocarbyl group constitutes the less preferred cycloalkyl group, it may be substituted with a $C_1$ to $C_{18}$ straight-chained alkyl group, preferably $C_2$ to $C_8$.

Representative examples of suitable hydrocarbyl groups for alcohols (I) and (II) include methyl, ethyl, propyl, butyl, pentyl, hexyl, heptyl, octyl, 2-ethylhexyl, isooctyl, tertiary-octyl, nonyl, isononyl, tertiary-nonyl, secondary-nonyl, decyl, isodecyl, undecyl, dodecyl, tridecyl, palmityl, stearyl, isostearyl, octenyl, nonenyl, decenyl, dodecenyl, oleyl, linoleyl and linolenyl, cyclooctyl, benzyl, octylphenyl, dodecylphenyl, and phenyloctyl.

The preferred hydrocarbyl groups for alcohol (I) are hexyl, octyl, decyl, and dodecyl. The preferred hydrocarbyl groups for alcohol (II) are, for $R_1$: methyl, ethyl, and propyl; and, for $R_2$: methylene, ethylene, propylene, and isopropylene. Alcohols (I) and (II) may be prepared by conventional methods widely known in the art. For example, a thioalcohol is produced by oxyalkylation of a mercaptan containing the desired hydrocarbyl group. Suitable oxyalkylating agents include alkylene oxides such as ethylene oxide, propylene oxide, butylene oxide, and mixtures thereof. The most preferred alkylene oxide is ethylene oxide. Thus, the preferred thioalcohol may be prepared by the following reaction equation:

$$RSH + \text{Ethylene Oxide} \rightarrow RSCH_2CH_2OH \qquad \text{(III)}$$

where R is defined above.

To produce the desired alcohol, a more preferred reaction route is shown below:

$$RCH{=}CH_2 + HSR_1OH \rightarrow RCH_2CH_2SR_1OH \qquad \text{(IV)}$$

wherein R and $R_1$ are described above. Reaction equation (IV) is preferred because it yields a higher percentage of the desired alcohol whereas reaction equation (III) may produce a single alcohol of the formula $RS(CH_2CH_2O{-})_n{-}H$, where $n>1$, or a mixture of alcohols where $n>1$ and varies.

The most general form of the reaction product of this invention is illustrated below:

$$\text{(a) } A{-}OH + \text{(b) } OH{-}B{-}OH + P_2O_5 \longrightarrow (A)_x{-}\overset{\overset{\displaystyle O}{\|}}{P}{-}(OH)_y \qquad \text{(V)}$$

where A and B are defined above, $4 \leqq a+2b \leqq 10$; $2b \leqq a$; and x and y represent integers whose sum is 3.

The preferred reaction product of this invention is formed by a monoalcohol and may be represented by the following equation:

$$RSCH_2CH_2OH + P_2H_5 \longrightarrow (RSCH_2CH_2O)_x{-}\overset{\overset{\displaystyle O}{\|}}{P}{-}(OH)_y \qquad \text{(VI)}$$

where R, x, and y are defined above.

The reaction conditions for equation (VI) are generally known in the art. Typically, the reaction is carried out under atmospheric pressure and at mild temperatures ranging from about 60° to 90° C. Mild temperatures are preferred because these conditions favor esterification. Reactions conducted at temperatures of about 100° C. and higher tend to favor formation of non-phosphorus containing products. Reaction times range from about 1.5 to about 6 hours. Sufficient esterification can typically be achieved at a reaction time of about four hours.

The preferred reaction route is first to slurry the appropriate amount of phosphating agent in a hydrocarbon solvent (e.g., mineral oil, heptane, xylene). Appropriate reactant amounts are discussed below, and the same reaction conditions described above apply. The slurry reaction route is preferred over other known routes because it reduces the tendency of the phosphating agent to agglomerate, which enhances full reaction of the phosphating agent. This method also facilitates agitation and cooling and minimizes temperature rise during alcohol addition. Additionally, it allows the phosphating agent to be reacted with low ratios of alcohol, which affords better control in forming the desired reaction product. Otherwise, adding phosphating agent to alcohol leads to different products.

The ratio of reactants, i.e., alcohol to phosphating agent, range from about 4:1 to 10:1. At reactant ratios of about 3:1 and lower, the reaction product is unstable in addition to being undesirably aggressive to silicone-based seals. At reactant ratios above 10:1, the antiwear benefits tend to diminish. More stable reaction products are formed at reactant ratios ranging from about 4:2to 6:1; the preferred ratios are between 5:1 and 6:1.

After the reactants have sufficient time to esterify, the reaction products may be placed under vacuum to remove water and excess solvent. Stripping times and temperatures vary according to the vapor pressure of the solvent and desired degree of stripping. The vacuum can range from about −65 to about −90 kPa, stripping times from about 1 to about 2 hours, and temperatures from 50° to 150° C. Typically, sufficient solvent removal may be achieved at a vacuum of about −60 kPa which is maintained for about one hour at 70° C.

The reaction products shown in equations (V) and (VI) may be added to a lubricating oil basestock in an amount sufficient to impart antiwear and antioxidant properties. The typical range is 0.05 to 1.0 weight percent of 100% active ingredient, preferably 0.4 to 0.8 weight percent, most preferably 0.5 to 0.7 weight percent. This corresponds to approximately 0.02 to 0.04 mass percent phosphorus in the oil.

Desirably, a source of boron is present with the reaction product of this invention in the lubrication oil basestock. The presence of boron tends to lessen the deterioration of silicone-based seals. The boron source may be present in the form of borated dispersants, borated amines, borated alcohols, borated esters, or alkyl borates. The molar ratio of boron to the phosphorus in the reaction product (B/P) is preferably 0.5 to 2.0.

Accordingly, by adding an effective amount of the reaction product of this invention to a lubricating oil and then placing the resulting lubrication oil within a lubrication system, the oil will inhibit wear in metal-to-metal contact, lessen oxidation of the lubrication fluid, and inhibit silicone seal deterioration.

The lubrication oil basestock may contain one or more additives to form a fully formulated lubricating oil. Such lubricating oil additives include corrosion inhibitors, detergents, pour point depressants, antioxidants, extreme pressure additives, viscosity improvers, friction modifiers, and the like. These additives are typically disclosed in, for example, "Lubricant Additives" by C. V. Smalheer and R. Kennedy Smith, 1967, pp. 1-11 and in U.S. Pat. No. 4,105,571, the disclosures of which are incorporated herein by reference. A fully formulated lubricating oil normally contains from about 1 to about 20 weight % of these additives. Borated or unborated dispersants may also be included as additives in the oil, if desired. However, the precise additives used (and their relative amounts) will depend upon the particular application of the oil. Contemplated applications for formulations of this invention include gear oils, industrial oils, lubricating oils, and power transmission fluids, especially automatic transmission fluids. The following list shows representative amounts of additives in lubrication oil formulations:

| Additive | (Broad) Wt. % | (Preferred) Wt. % |
|---|---|---|
| VI Improvers | 1–12 | 1–4 |
| Corrosion Inhibitor/ Passivators | 0.01–3 | 0.01–1.5 |
| Anti-oxidants | 0.01–5 | 0.01–1.5 |
| Dispersants | 0.10–10 | 0.1–8 |
| Anti-Foaming Agents | 0.001–5 | 0.001–1.5 |
| Detergents | 0.01–6 | 0.01–3 |
| Anti-Wear Agents | 0.001–5 | 0.001–1.5 |
| Pour Point Depressants | 0.01–2 | 0.01–1.5 |
| Seal Swellants | 0.1–8 | 0.1–6 |
| Friction Modifiers | 0.01–3 | 0.01–1.5 |
| Lubricating Base Oil | Balance | Balance |

Particularly suitable detergent additives for use with this invention include ash-producing basic salts of Group I (alkali) or Group II (alkaline) earth metals and transition metals with sulfonic acids, carboxylic acids, or organic phosphorus acids. The organic phosphorus acids are characterized by at least one direct carbon-to-phosphorus linkage such as those prepared by the treatment of an olefin polymer (e.g., polyisobutene having a molecular weight of 500) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium, and barium. Desirably, the Group I, Group II, or transition metal is present in the metal to phosphorus molar ratio ($M^+/P$) of 0.005 to 0.5 in the reaction product.

Particularly suitable types of antioxidants for use in conjunction with the reaction product of this invention are the amine-containing and hydroxy aromatic-containing antioxidants. Preferred types of these antioxidants are alkylated diphenyl amines and substituted 2,6 di-t-butyl phenols. It is believed that a synergism in antioxidency exists between the foregoing antioxidants and the reaction product of this invention as demonstrated by the superior antioxidency properties of the following examples.

The reaction product of this invention may also be blended to form a concentrate. A concentrate will generally contain a major portion of the reaction product together with other desired additives and a minor amount of lubrication oil or other solvent. The reaction product and desired additives (i.e., active ingredients) are provided in the concentrate in specific amounts to give a desired concentration in a finished formulation when combined with a predetermined amount of lubrication oil. The collective amounts of active ingredient in the concentrate typically are from about 0.2 to 50, preferably from about 0.5 to 20, most preferably from 2 to 20 weight % of the concentrate, with the remainder being a lubrication oil basestock or a solvent.

The reaction product of this invention may react with the amines contained in the formulation (i.e., dispersant, friction modifier, and antioxidant) to form quaternary ammonium salts. The formation of amine and quaternary ammonium salts, however, will not adversely affect the antioxidant or antiwear characteristics of this invention. In fact, the reaction product of this invention may be added to a lubrication oil in the form of an amine or quaternary ammonium salt of the reaction product. Typical amines with which this invention's reaction product may react include any amine that will react with the reaction product to fully or partially neutralize the product. Such amines include the primary, secondary, and tertiary aliphatic, alicyclic, aromatic, and heterocyclic amines, e.g., alkylamines such as the mono-, di-, and tri-methyl amines, propylamine, laurylamine, and stearyl amine; alkanolamines, e.g., ethanolamine; cyclohexylamines; phenylamines; morpholinylamines, pyridylamines; ethoxylated amines, e.g., ethoxylated rosin amines; morpholines; pyridines; phenanthridines; aminoimidazolines; rosin amines; fatty acid amines, e.g., coconut fatty acid amines; alkyl sulfonamides; alkylbenzenesulfonamides; anilines; alkylene polyamines, e.g., ethylene diamine; polyalkyleneimines, e.g., polyethyleneimine and the like. The described amines are merely illustrative of the wide variety of amine that may be used to form salts of the reaction product of the invention. One skilled in the art will readily determine other types of amines that may be used in a functionally equivalent manner. The amine salts of the reaction product may be converted to the corresponding quaternaries by well known methods with alkyl and aromatic halides, e.g., methyl iodide, and benzyl chloride.

Suitable lubrication oil basestocks can be derived from natural lubricating oils, synthetic lubricating oils, or mixtures thereof. In general, the lubricating oil basestock will have a viscosity in the range of about 5 to about 10,000 $mm^2/s$ (cSt) at 40° C., although typical applications will require an oil having a viscosity ranging from about 10 to about 1,000 $mm^2/s$ (cSt) at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof; and the like.

Synthetic .lubricating oils also include alkylene oxide polymers, interpolymers, copolymers, and their derivatives where the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicone-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hex-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydroforans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

This invention may be further understood by reference to the following examples which are not intended to restrict the scope of the appended claims.

EXAMPLE 1

This example illustrates this invention's ability to improve a lubrication oil's antiwear and antioxidizing properties and compatibility with silicone-based seals.

PART A

A lubrication fluid, herein designated as BASE FLUID A, was formulated from a basestock containing a borated PIBSA-PAM dispersant, a phenyl antioxidant, seal swelling agent, viscosity improver, and antifoamant.

PART B

To a sample=of BASE FLUID A was added 0.28 weight % of 2-ethyl-hexyl acid phosphate ("EHAP") available from Albright & Wilson. The resulting formulation is designated as Formulation A'.

PART C

Four moles of $C_8H_{17}SCH_2CH_2OH$ and 1 mole of $P_2O_5$ were reacted at a temperature of about 70° C. for about 2 hours to yield a reaction product. The elemental analysis of the reaction product was 14.5% S and 6.84% P.

To a sample of BASE FLUID A was added 0.43 weight % of this reaction product. The resulting formulation is designated as Formulation A".

PART D

The antiwear effectiveness of BASE FLUID A and Formulations A' and A" were then tested using the FZG Gear Test described in the DIN 51354 (Germany) official standard. Accordingly, the gear set was run lubricated by the appropriate formulation at increasing load stages until scoring of the gear tooth flank occurred. Therefore, failure of a formulation at higher load stages is desirable. Results of this test are given below in Table 1.

TABLE 1

| FLUID | FZG LOAD STAGE AT FAILURE |
|---|---|
| BASE FLUID A | 7 |
| FORMULATION A' | 11 |
| FORMULATION A" | 12 |

Table 1 shows that Formulation A", which contained the reaction product of this invention, has antiwear effectiveness modestly better than Formulation A', which contained EHAP, and substantially better than BASE FLUID A, which contained no antiwear agent.

PART E

BASE FLUID A and Formulations A' and A" were then tested by the Laboratory Multiple Oxidation Test ("LMOT"). In this test, 50 grams of test fluid with 2 grams of iron filings and 0.5 grams of a 1% solution of copper naphthenate were heated to 149° C. and 25 ml air per minute were concurrently passed through the sample. Daily samples were taken, and the number of days for visible sludge to appear on blotter paper was recorded. The number of days for visible sludge to appear is the measured rating of the antioxidation effect. The results are summarized in Table 2.

TABLE 2

| FLUID | DAYS TO FAILURE |
|---|---|
| BASE FLUID A | 9 |
| Formulation A' | 16 |
| Formulation A" | 23 |

The data show that the reaction product of this invention significantly improved oxidation inhibiting effectiveness compared with BASE FLUID A and Formulation A'.

PART F

The silicone-seal compatibility of BASE FLUID A, Formulations A', and A" was then tested according to the Ford Silicone Seal Reversion Test—ATTR 300, Section 3.10.

FORD ATTR 300 SILICONE SEAL REVERSION TEST

Six strips of reference elastomer were cut in accordance with ASTM D 471 and immersed in 3 tubes in accordance with ASTM D 471 paragraph 7.1. Two of the tubes contained a reference fluid, and one of the tubes contained a sample of the fluid to be tested. The reference elastomer used was ATRR 300, and the reference fluid used was Ford Mercon® reference fluid (Exxon FN 1975).

The reference elastomer strips remained immersed for 240 hours at a temperature of 163°±3° C.

The reference elastomers were then tested for reversion by smear testing. The smear testing consisted of sliding the aged reference elastomer samples across a section of white cardboard under approximately 1.8 kg thumb force. The aged reference elastomer showed no reversion because the color smear of the aged elastomer was no greater than that produced by sliding an unaged coupon across an identical section of white cardboard under the same 1.8 kg thumb force.

The results of testing each formulation for silicone reversion are summarized in Table 3.

TABLE 3

| FLUID | SILICONE SEAL TEST |
|---|---|
| BASE FLUID A | Passed |
| Formulation A' | Failed |
| Formulation A" | Passed |

As can be seen from this table, Formulation A", which contained the reaction product of this invention, passed the reversion test whereas Formulation A', which contained EHAP, failed the test. The failure of Formulation A' was significant because a red paste was formed when the elastomeric sample, which had been soaked in Formulation A', was slid across the cardboard This indicated severe deterioration of the elastomer.

EXAMPLE 2

This example illustrates this invention's ability to improve an ATF's antiwear and antioxidancy properties, compatibility with silicone-based seals, and ability to pass an ATF friction test.

PART A

An ATF, herein designated as BASE FLUID B, was formulated from a basestock containing borated PIBSA/PAM dispersant, a phenyl antioxidant, seal swellant, friction modifier, and viscosity improver.

PART B

One mole (142 grams) of $P_2O_5$ was slurried in 1120 grams of Exxon Solvent 75 Neutral basestock. Six moles (1140 grams) of $C_8H_{17}SCH_2CH_2OH$ was added to the slurried P205. The temperature rose from 23° C. to 41° C. The temperature was raised to 75° C., and the reaction mass held at this temperature for 3 hours. The elemental analysis revealed the reaction product was comprised of 8.44% sulfur and 2.51% phosphorus. The product contained 46% basestock.

A sample of the reaction product was added at approximately 1.24 weight % to a sample of Base Fluid B The resulting formulation is designated as Formulation B'.

PART C

BASE FLUID B and Formulation B' were tested for antiwear effectiveness using the FZG Gear Test described in Part D of Example 1. The results are summarized below in Table 4.

TABLE 4

| FLUID | FZG LOAD STAGE AT FAILURE |
|---|---|
| BASE FLUID B | 7 |
| Formulation B' | 13 |

As can be seen from Table 4, Formulation B', which contains the reaction product of this invention, yields a significant improvement in wear resistance compared with BASE FLUID B which contained no antiwear additive.

PART D

BASE FLUID B and Formulation B' were tested for antioxidation effectiveness under the LMOT test described in Part E of Example 1. The results are summarized below in Table 5.

TABLE 5

| FLUID | DAYS TO FAILURE |
|---|---|
| BASE FLUID B | 7 |
| Formulation B' | 23-24 |

The data in Table 5 show that Formulation B', which contained the octylthioethyl phosphate, yields a nearly 4-fold improvement in antioxidancy compared with BASE FLUID B which contained a conventional antioxidant additive.

PART E

Formulation B' was then tested according to the Ford Silicone Seal Reversion Test—ATRR 300 described in Part F of Example 1. Formulation B' passed the test, which demonstrates the present invention's compatibility with silicone-based seals.

PART F

Formulation B' was tested according to the Mercon 4000 cycle friction test to demonstrate that this invention does not adversely affect the frictional stability of the friction modifier present in BASE FLUID B.

MERCON 4000 CYCLE FRICTION TEST

This test used a SAE No. 2 type friction machine which operated successfully for 4000 cycles with no unusual clutch plate wear or composition-face plate flaking. The test was conducted in a continuous series of 20 second cycles, each cycle consisting of three phases as follows:

Phase I (10 seconds)—motor on at a speed of 3600 rpm, clutch plates disengaged.

Phase II (5 seconds)—motor off, clutch engaged.

Phase III (5 seconds)—motor off, clutch released.

Throughout the 4000 cycles, Formulation B′ was maintained at an average fluid temperature of 115°±5° C. Flywheel torque was maintained at 20740±3 kPa. During the clutch engagement, friction torque was recorded as a function of time as the motor speed declined from 3600 rpm to 0. From the torque traces, the dynamic torque ($T_{1800}$) was determined midway between the start and end of clutch engagement (i.e., at a motor speed of 1800 rpm), and the static torque was determined at 200 rpm ($T_{200}$). An acceptable torque ratio results when ($T_{200}/T_{1800}$) of the 200th cycle falls between 0.90–1.00. The torque ratio ($T_{200}/T_{1800}$) of Formulation B′ measured 0.94 at the 200th cycle, which is within the acceptable range. Thus, the reaction product of this invention was found to be acceptable for use in ATF.

What is claimed is:

1. A lubricating oil composition comprising:

(a) a major amount of a lubrication oil basestock; and (b) a lubrication oil additive and the amine salts thereof, wherein the additive comprises the reaction product of a phosphating agent and an alcohol represented by formula I:

$$A—OH \qquad (I)$$

wherein

A is $$\begin{array}{l} Y \\ | \\ CH—(OCH_2CH_2)_n— \\ | \\ X \end{array} \quad \text{or} \quad \begin{array}{l} Y—CH—(OCH_2CH)_n; \\ \qquad\;\; | \qquad\quad\;\; | \\ \qquad\;\; X \qquad\quad CH_3 \end{array}$$

X is H or $RSCH_2$—;

Y is $RSCH_2$—, $$\begin{array}{l} RSCHCH_2—, \\ \quad\;\; | \\ \quad\;\; CH_3 \end{array} \quad \begin{array}{l} RSCHCH_2—, \\ \quad\;\; | \\ \quad\;\; CH_2 \\ \quad\;\; | \\ \quad\;\; CH_3 \end{array}$$

n is an integer from 0–12;

R is H or a hydrocarbyl group containing up to 50 carbon atoms; and the molar ratio of alcohol to phosphating agent ranges from about 4:1 to 10:1.

2. The composition of claim 1, wherein is alkyl, alkenyl, cycloalkyl, aralkyl, or alkaryl.

3. The composition of claim 1, wherein A is $RSCH_2CH2$—, R is a $C_1$–$C_{15}$ alkyl, and the phosphating agent is phosphorus pentoxide.

4. A lubricating oil composition of claim 1, further comprising an amine-containing or hydroxy aromatic-containing antioxidant.

5. A lubricating oil composition comprising of claim 1, further comprising a source of boron where the molar ratio of boron to phosphorus is 0.5 to 2.0.

6. A lubricating oil composition of claim 1, further comprising a Group I, Group II, or transition metal, where the molar ratio of metal to phosphorus is 0.005 to 0.5.

7. The method of inhibiting wear, oxidation, and silicone seal deterioration in a lubrication oil system, which comprises using a lubrication oil containing an effective amount of the reaction product of claim 1.

8. A concentrate composition comprising a major amount of lubrication oil basestock and a minor amount of the reaction product of claim 1.

* * * * *